US006131884A

United States Patent [19]

Broussard et al.

[11] Patent Number: 6,131,884

[45] Date of Patent: Oct. 17, 2000

[54] TOOL FOR EXTRACTION OF STAKES

[76] Inventors: Frank Broussard, 2002 Sheffield Dr., El Dorado Hills, Calif. 95762; Eric Broussard, 114 Rancho Cir., Auburn, Calif. 95603

[21] Appl. No.: 09/392,850

[22] Filed: Sep. 9, 1999

Related U.S. Application Data

[63] Continuation-in-part of application No. 09/062,573, Apr. 20, 1998, abandoned.

[51] Int. Cl.[7] ..... E21B 19/00

[52] U.S. Cl. ..... 254/30; 254/129

[58] Field of Search ..... 254/30, 31, 131, 254/132, 133, DIG. 1, 29 R, 129, 130

[56] References Cited

U.S. PATENT DOCUMENTS

| | | | |
|---|---|---|---|
| 407,529 | 7/1889 | Hollenbeck | 254/130 |
| 1,164,598 | 12/1915 | Engle . | |
| 1,426,068 | 8/1922 | Howe | 254/130 |
| 1,761,675 | 6/1930 | Mick | 254/132 |
| 2,777,726 | 7/1957 | Lundgren et al. | 254/30 |
| 3,048,368 | 8/1962 | Linabery | 254/132 |
| 3,991,976 | 11/1976 | Skinner | 254/30 |
| 4,250,769 | 2/1981 | Herring | 254/129 |
| 4,365,786 | 12/1982 | Osteen . | |
| 5,052,659 | 10/1991 | Bates . | |
| 5,186,437 | 2/1993 | Scott . | |
| 5,224,687 | 7/1993 | Geckler . | |
| 5,464,192 | 11/1995 | Burnham . | |
| 5,499,795 | 3/1996 | Mathews . | |
| 5,597,151 | 1/1997 | Duncan . | |
| 5,833,215 | 11/1998 | Vandenburg . | |
| 5,855,358 | 1/1999 | Witter . | |
| 5,934,649 | 8/1999 | Drane | 254/30 |

*Primary Examiner*—Robert C. Watson
*Attorney, Agent, or Firm*—John P. O'Banion

[57] ABSTRACT

A tool for the extraction of wood or metal stakes and poles from the ground. In the preferred embodiment, the tool includes a vertical support attached to a base, a lever arm, a stake engaging head having plurality of arms and a positioning handle, and an elongate connecting member connecting the head with the lever arm. The connecting member can be positioned at different locations along the shorter lever arm providing different leverage options to the user when unusual resistance to removal is encountered. The engaging head has a face with a fixed projection and an adjustable projection. The stake or post is placed between the two projections which frictionally engage the stake. The adjustable projection on the head allows the device to receive essentially any size of stake or post. In the alternate embodiment, all of the projections on the engaging head are fixed in positions which correspond with conventional wood and metal stakes. The positioning handle attached to the engaging head can be secured to the top of the device and retained with a clip for easy transportation and storage.

29 Claims, 6 Drawing Sheets

TOOL FOR EXTRACTION OF STAKES

CROSS-REFERENCE TO RELATED APPLICATIONS

This application is a continuation-in-part of application Ser. No. 09/062,573 filed on Apr. 20, 1998 now abandoned.

STATEMENT REGARDING FEDERALLY SPONSORED RESEARCH OR DEVELOPMENT

Not Applicable

Reference to a Microfiche Appendix

Not Applicable

BACKGROUND OF THE INVENTION

1. Field of the Invention

This invention pertains generally to farm and construction tools, and more particularly to an improved manual stake or post extraction device.

2. Description of the Background Art

In commercial and residential construction projects, stakes made of metal or wood are used in many applications. Typically, a foundation or footing is constructed by pouring concrete into forms that are properly positioned by stakes securely embedded in the ground. Stakes may also be used to establish boundary lines or markers at a construction site. In addition, temporary barriers and fencing are primarily created by driving metal posts into the ground.

Disassembly of concrete forms after the concrete has solidified, as well as the removal of temporary barriers, ultimately requires the removal of the supporting stakes or posts. However, the removal of a post or stake can be quite difficult. Attempts to dislodge a wooden stake or post by hand can often result in the post breaking and leaving a portion of the post in the ground. Removal of the broken pieces requires digging, thereby disrupting the soil surrounding the formed concrete and potentially compromising the concrete. Aggressive attempts to remove a post or stake without mechanical assistance may also lead to injury. Thus, breakage of the stake or post is undesirable because it results in additional work and lost time for the workman and possible damage to concrete structures.

Posts and stakes come in a variety of cross-sectional shapes and diameters. The cross-section may be round, square, rectangular or "T"0 shaped. Many post pulling tools found in the prior art are limited to removing posts with a particular cross sectional shape. For example, U.S. Pat. No. 5,224,687 issued to Geckler discloses a device for removing a post with a generally "T"0 shaped cross-section which utilizes an engagement plate and a conventional jack. The Geckler device would not be suitable for removing square, round or rectangular stakes or posts. Similarly, the post puller described in U.S. Pat. No. 5,186,437 issued to Scott also uses an engagement plate adapted to receive a square post and has similar limitations. Likewise, the device described in U.S. Pat. No. 5,052,659 issued to Bates in 1991 is limited to removing stakes with a round cross-section within a specific range of circumferences. These representative prior art devices are limited to removing posts with a certain cross sectional shape and therefore cannot be used for removing stakes with differing cross-sectional shapes or sizes.

Another deficiency in existing prior art pullers is that the engagement plate must be placed over the top of the post or stake and brought down to the proper position before extraction. This requires the user to remove nails or other obstructions before the device can be used. Such a requirement increases the overall time and work required to extract each stake. For example, the post puller disclosed in U.S. Pat. No. 5,464,192 to Burnham requires the post to be placed between two "gripper bars"0 in the head of the device. During use, the entire Burnham apparatus must be lifted up and over the top of each post.

Yet another deficiency in prior art devices is that such devices cannot be used to pull stakes that abut a board or concrete form. For example, the post puller disclosed in U.S. Pat. No. 5,833,215 to Vandenburg requires the engaging head to completely surround the post limiting the use of the apparatus to free standing posts. Likewise, the stake pulling apparatus of U.S. Pat. No. 5,597,151 issued to Duncan requires the stake to be surrounded by the stake engagement head and is therefore limited to removal of free standing stakes.

Accordingly, there is a need for a for a mechanical device to remove a stake that abuts a vertical object, that can remove stakes of varying cross-sectional sizes and shapes; and can quickly engage the stake without requiring excessive activity by the user.

BRIEF SUMMARY OF THE INVENTION

By way of example and not of limitation, the present invention is a manually operated stake and post extracting tool utilizing a fulcrum and lever to gain a mechanical advantage which is suitable for use on wood or metal stakes. The extractor constructed in accordance with the present invention has a base, a vertical support acting as a fulcrum, a lever arm pivotally attached to the vertical support, and a stake engaging head that is attached to the lever arm. The stake engaging head is spatially separated from the lever arm and connected to one end of the arm by a chain or a solid force transferring member. This separation allows the upward extracting force applied to the stake to be parallel to the stake and perpendicular to the ground. In addition, the chain can be connected to the small lever arm at various points along its length thereby allowing the user to increase the mechanical advantage of the device.

The preferred embodiment of the stake engaging head has an elongate body with two perpendicular arms, one being fixed and the other one being adjustable along the length of the body. The stake is placed in between the arms and the adjustable arm is positioned to the width of the stake. In an alternative embodiment, the stake engagement head has a generally trident shape with the center and either one of the outside arms frictionally engaging the surface of the stake during use. The distance between the central arm and the outer arms is selected to approximate the width of a standard rectangular stake for one and the diameter of a conventional cylindrical metal stake for the other.

The preferred embodiment of the stake engaging head also includes a shaft and handle to aid in the horizontal and vertical alignment of the head on the stake to be removed. The length of the shaft allows the user to position the head without bending down. The handle allows the user to quickly reposition the head for stakes requiring several pulls such as when a stake is deeply embedded in the ground.

An object of the invention is to provide a stake or post pulling device that has a head structure that is adapted to engage stakes of varying sizes and shapes.

Another object of this invention is to provide a device that can pull wood or metal posts or stakes from the ground without requiring the user to exchange engagement heads.

Yet another object of the invention is to provide a puller that is not limited to removing free standing stakes or posts but can remove stakes that abut boards, walls or the like.

Still another object of this invention is to provide a stake or post puller which exerts an upward force on the stake parallel with the position of the stake or post.

Another object of this invention is to provide a device that is easy to use and easily operated by one person.

Still a further object of the invention is to provide a device for pulling stakes or posts which includes a means of positioning the engagement head that does not require the user to bend down to place and align the head.

It is another object of the invention to provide a puller which is durable in construction, compact and can be easily moved from place to place.

Another object of the invention is to provide a puller which can be manufactured efficiently and reliably.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DETAILED DESCRIPTION OF THE INVENTION

Referring more specifically to the drawings, for illustrative purposes, the present invention is embodied in the apparatus generally shown in FIG. 1 through FIG. 6. It will be appreciated that the apparatus may vary as to configuration and as to details of the parts without departing from the basic concepts as disclosed herein.

Figure 1:
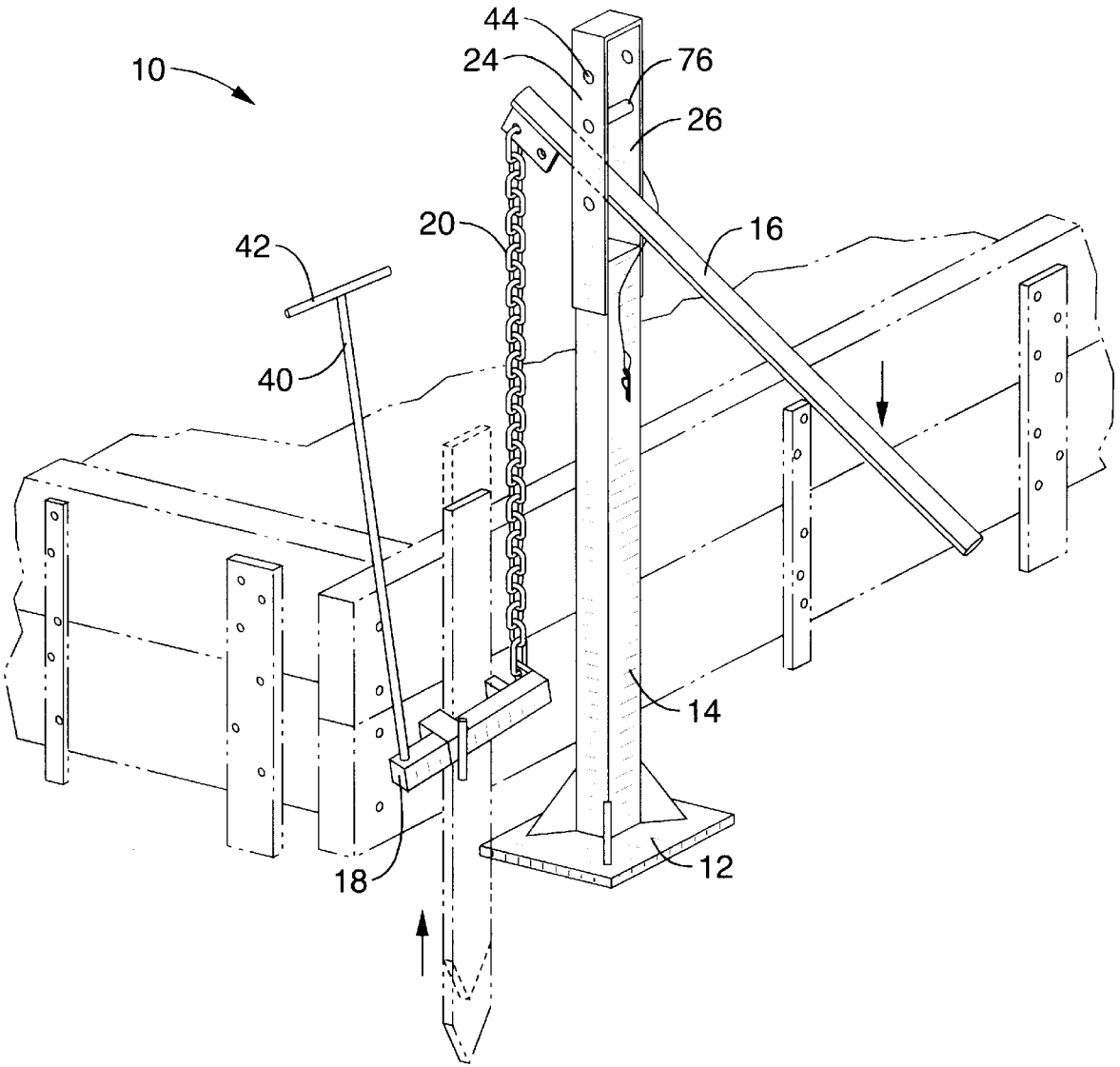
FIG. 1 is a perspective view of the present invention in context of use showing the extraction of a wooden stake which abuts concrete form boards.

Referring first to FIG. 1, it will be seen that stake extractor 10 in accordance with the present invention generally comprises a horizontal base 12, a vertical support member 14 acting as a fulcrum, a lever arm 16 pivotally connected to the support member, a stake or post engaging head 18, and a connecting chain 20 or rod connecting the head 18 to the lever arm 16. The arrows in FIG. 1 show the direction of motion of the lever arm and the corresponding motion of the stake during removal. FIG. 1 also illustrates the capability of the invention to remove stakes that abut boards or concrete forms and the like.

Figure 2:
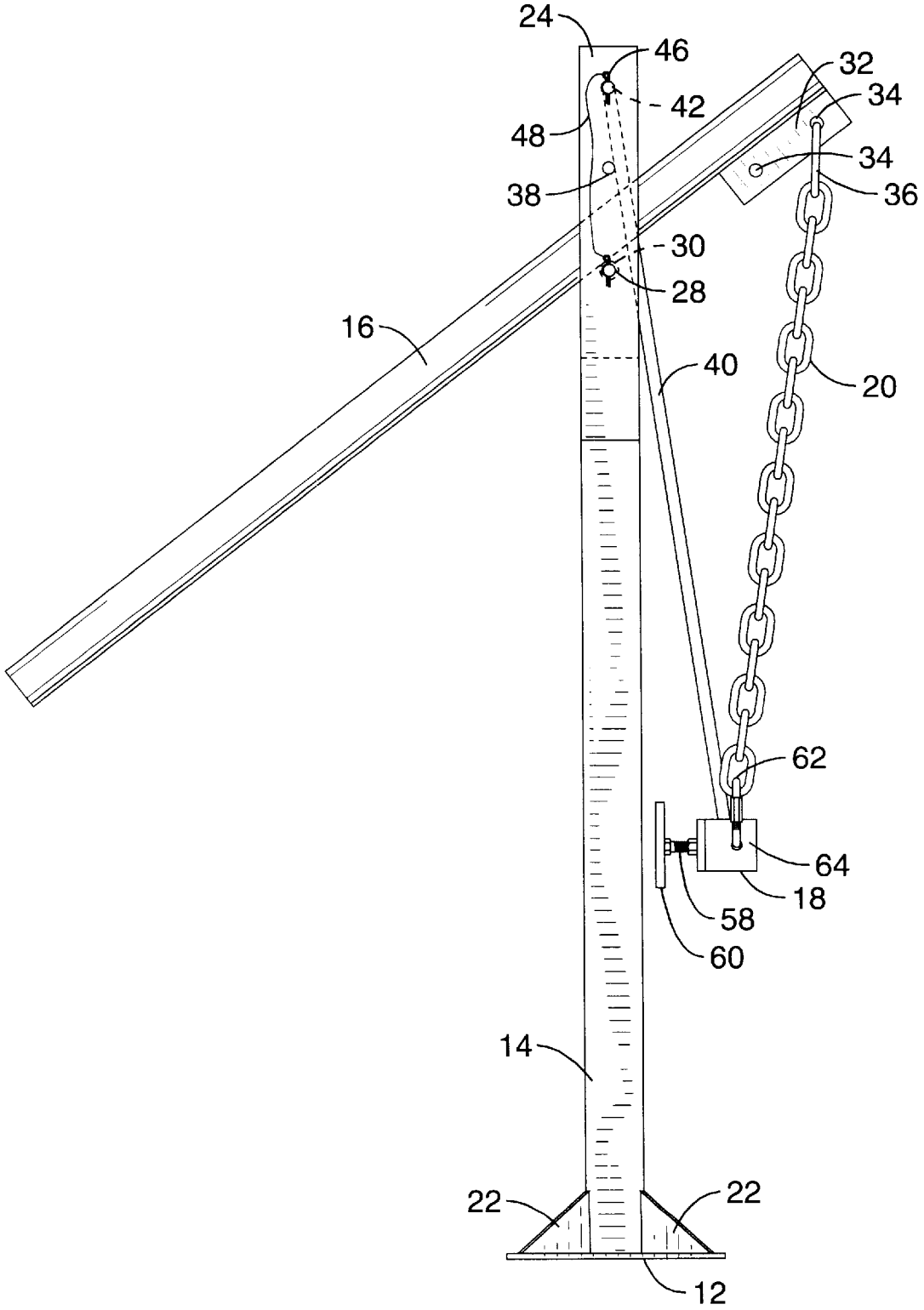
FIG. 2 is a side elevation view of the apparatus of FIG. 1 showing the lever arm partially extended.
Figure 3:
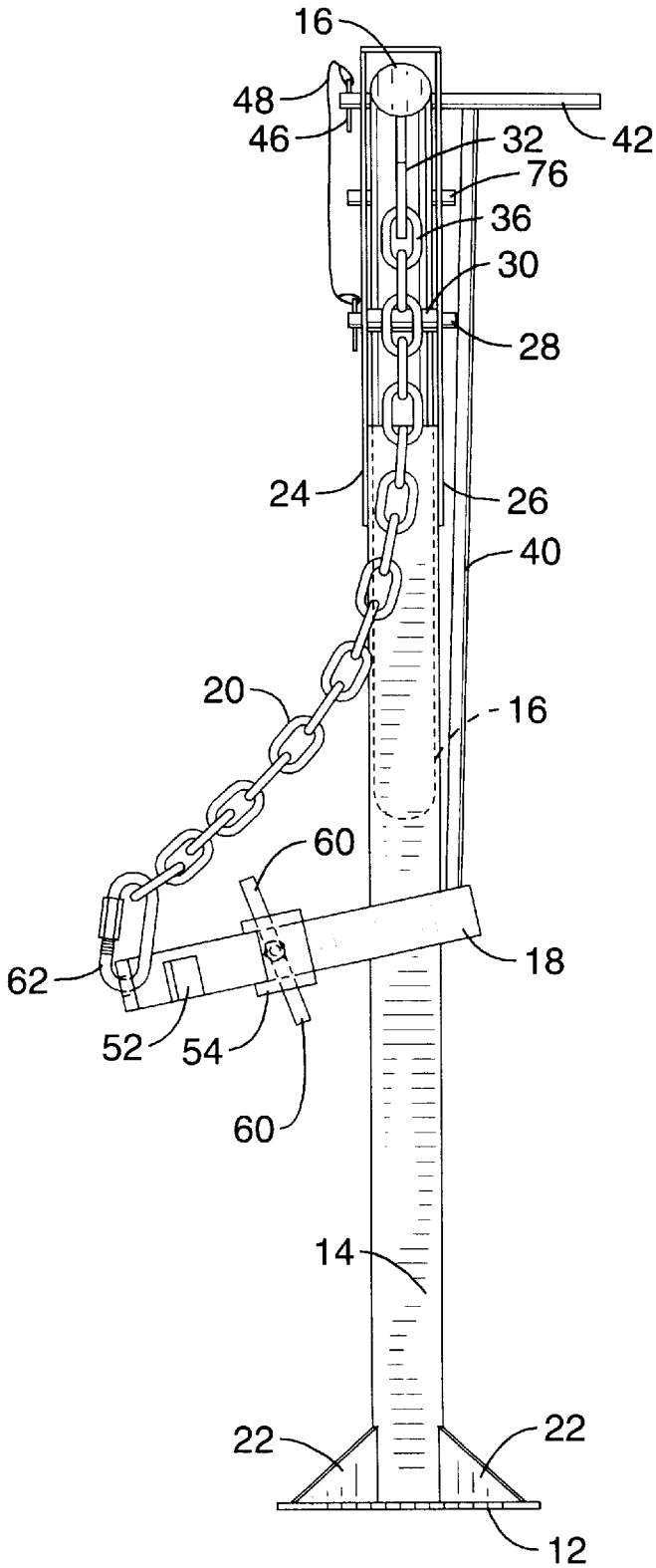
FIG. 3 is a front view of the apparatus of FIG. 1 showing the handle locked into the top portion of the fulcrum with a pin.

Referring next to FIG. 2 and FIG. 3, it can be seen that one end of vertical support 14 is centered and then welded or otherwise permanently fixed to the base 12. The vertical support 14 is further secured to the base and strengthened by diagonal web bracing 22. It is preferred that the web bracing be affixed at 45 degree angles taken from the edges of the base. The base 12 is also dimensioned so as to allow the apparatus to stand freely.

A pair of upright projections 24, 26 are preferably joined together at the top and attached on opposing sides of the vertical support member 14 at the end opposite the horizontal base 12. Each of the upright projections 24, 26 has any number of apertures 38 located in the identical positions along the length of the upright projections such that the apertures of each projection horizontally align. The lever arm 16 is placed between the two upright projections 24 and 26 and pivotally attached to the uprights by a pivot pin 28.

The lever arm 16 has a tube 30 that has a diameter than is slightly larger that pivot pin 28 and that can readily receive pin 28. The length of tube 30 is the greater than the diameter or width of the lever arm 16. Tube 30 is fixed to lever arm 16 so that the length of the tube is perpendicular to the length of the lever arm.

The placement of the pivot pin 28 in relation to the vertical support 14 can be adjusted vertically. Vertical adjustment is accomplished by placing lever arm 16 between vertical projections 24 and 26 and aligning tube 30 with the desired apertures 38. Pivot pin 28 is then placed through one aperture, through tube 30 and then through the corresponding aperture 38 in the opposite vertical projection.

The short end of the lever arm 16 has a flange 32 projecting downwardly. Flange 32 has one or more bores 34 that permit the attachment of connecting chain 20 to lever arm 16. Preferably, connecting chain 20 is attached to flange 32 through bore 34 by a quick release fastener 36 such as a carabeener. Fastener 36 can be placed in any one of the bores 34 to adjust the mechanical advantage of the device. Thus, the needed work force to be applied to the long lever arm can be quickly adjusted by moving the fastener 36 attachment point along the length of the short lever arm.

Figure 5:
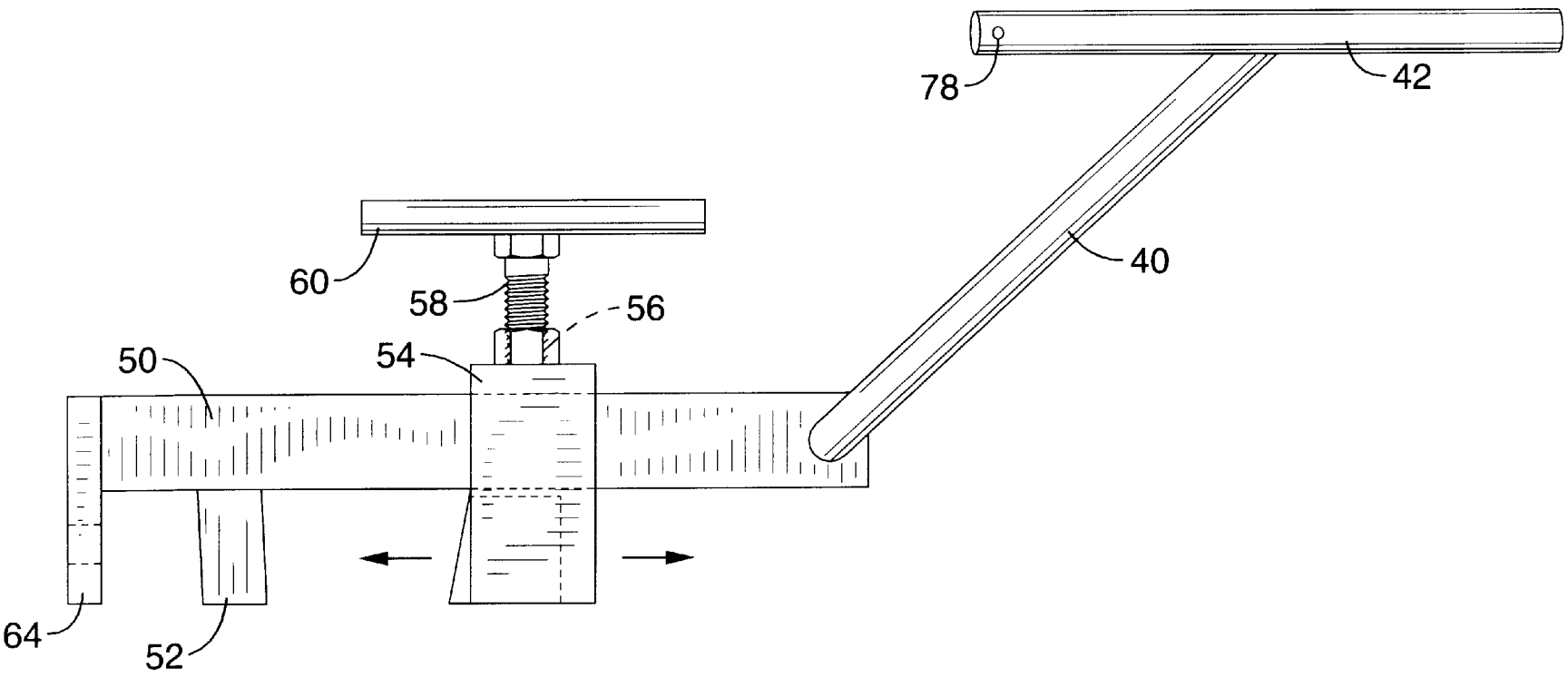
FIG. 5 is top plan view of the engaging head of FIG. 4 showing the handle and the fixed and adjustable arms.
Figure 6:
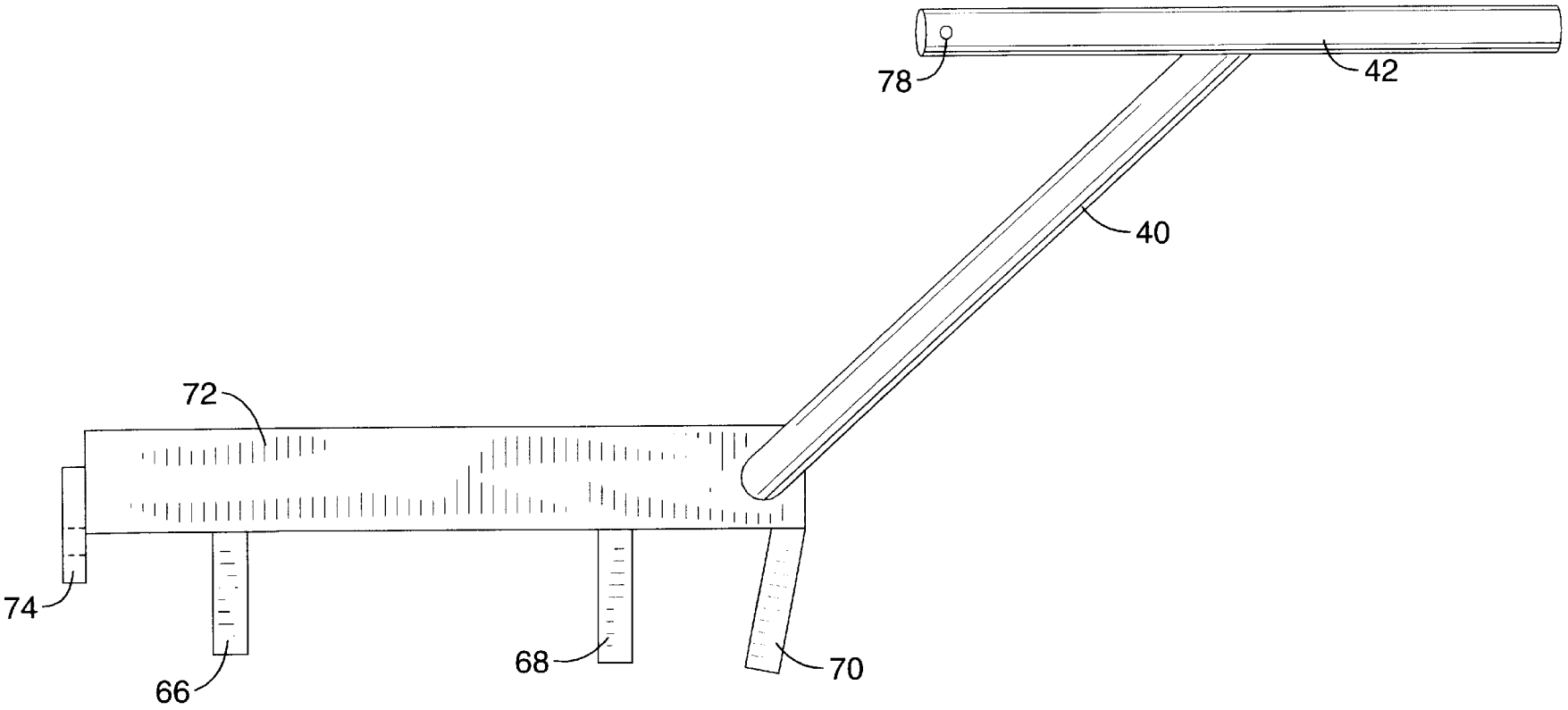
FIG. 6 is top plan view of an alternative embodiment of the stake engaging head shown in FIG. 4 where the engaging arms are fixed in specific locations on the head corresponding with the usual dimensions of wooden and metal stakes.

When not in use, the extractor 10 can be configured for easy storage. The lever arm 16 can pivot so as to be parallel to the vertical support member 14. As shown in FIG. 3, the stake engaging head 18 has a positioning handle assembly comprising a shaft 40 and a handle 42. During storage and transport, the handle 42 is placed through a pair of apertures 44 in the pair of upright projections 24, 26 on the vertical support 14. In the preferred embodiment, the handle is retained in projections 24, 26 by a stop pin 46 that is placed through hole 78 in handle 42, as shown in FIG. 5 and FIG. 6. The stop pin 46 is attached to a tether 48 to avoid loss of the stop pin and to have the pin readily accessible for use.

It is preferred that the apertures 44 are placed in projections 24, 26 at a position such that the handle 42 prohibits the lever arm 16 from extending when the handle 42 is placed after the lever arm is collapsed down parallel with the vertical member 14. In this configuration, the lever arm 16 is locked in place parallel to the vertical support 14 until the stop pin 46 and handle 42 are removed from the apertures 44.

Figure 4:
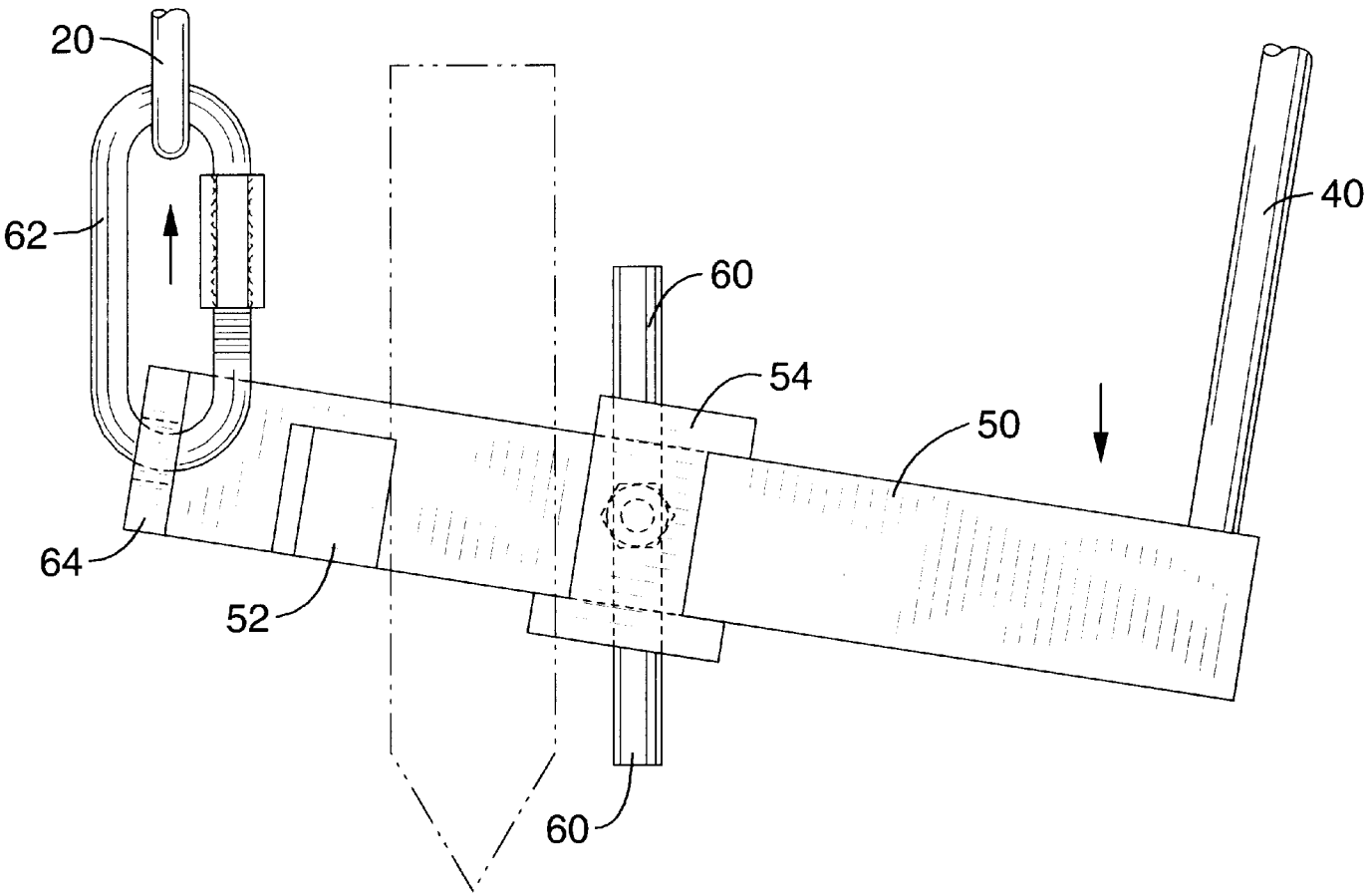
FIG. 4 is fragmentary front view of the stake engaging head portion of the apparatus of FIG. 1 showing the stake in relation to the permanent and adjustable arms.

FIG. 4 and FIG. 5 illustrate the preferred embodiment of the stake engaging head 18. The engaging head 18 has an elongated body 50 that has two stake engaging arms 52, 54. Engaging arm 52 is fixed on the body 50 to extend substantially perpendicular in relation to the front of the body. In the preferred embodiment, engaging arm 52 is fixed at an angle less than ninety degrees in relation to the body 50. Engaging arm 54 on the other hand has an engaging angle that is greater than ninety degrees with respect to the plane of the elongate body.

Engaging arm 54 is adjustable along the length of the elongate body 50. After being properly aligned, arm 54 is anchored to body 50. Arm 54 has a threaded bore 56 which receives a threaded shaft 58 which frictionally engages the elongate body 50 anchoring the arm in position. Threaded shaft 58 is provided with a handle 60 to facilitate turning the shaft 58 to allow the user to quickly anchor and release arm 54. The adjustability of arm 54 allows the head to efficiently engage stakes of different widths without the need of changing heads.

Engaging head 18 is attached to connecting chain 20 by a locking fastener 62 through a bore on lobe 64 of body 50. The attachment point of fastener 62 on elongate body 50 is preferably on the opposite side of the body as the attachment point of the shaft 40 with positioning handle 42. The points of engagement of arms 52 and 54 with the stake is illustrated in FIG. 4. It will be appreciated that additional frictional force can be exerted by the head on the stake, if necessary, by the user pushing downwardly on the positioning handle 42 at the same time the lever arm 16 is manipulated.

FIG. 6 shows an alternative embodiment of engaging head 18. Engaging arms 66, 68, 70 are fixed on elongate body 72. The engaging arms 66, 68 are positioned on the body 72 to correspond with the customary widths of conventional wood stakes. Arms 68, 70 are positioned to correspond with the circumference of conventional metal stakes. Locking fastener 62 attaches to this alternative head through lobe 74.

In use, arm 54 is adjusted to approximate the width of the stake to be removed. The engaging head 18 is then maneuvered horizontally and vertically by handle 42 to properly align the head 18 and engaging arms 52, 54 on the stake to be removed. Handle 42 allows the user to position the head 18 while maintaining an upright position, not known in the art, thereby reducing the time and energy necessary to remove the stake. Once the head is aligned, lever arm 16 is manipulated downward causing the connecting rod or chain 20 to be raised and the engaging head 18 to move upwardly. The upward force of the small lever arm causes engaging arms 52, 54 of head 18 to engage the stake and extract the stake. If the post or stake is deeply embedded into the ground, it may be necessary to repeat the position and pull events several times to remove the stake.

When stakes are being removed, it may be desirable to reduce the distance that head 18 is moved upwardly. The rotation of the lever arm can be limited with a stop peg 76 which is placed through a pair of apertures 38 in upright projections 24, 26. Peg 76 is placed above the lever arm 16 and pivot pin 28 and blocks the generally upward movement of the small lever arm after a certain point.

Although the description above contains many specificities, these should not be construed as limiting the scope of the invention but as merely providing illustrations of some of the presently preferred embodiments of this invention. Thus the scope of this invention should be determined by the appended claims and their legal equivalents.

What is claimed is:

1. A stake or post extracting device, comprising:

(a) a base;

(b) a vertical support member having an upper end and a lower end, said lower end securely attached to the base;

(c) a lever arm having a forward end and a rearward end, said lever arm pivotally connected to the vertical support member;

(d) an engaging head, said engaging head having a plurality of outwardly extending projections extending;

(e) an elongate coupling member having first and second sections, said first section coupled to said forward end of said lever arm, said second section coupled to said engaging head; and (f) a positioning handle comprising (i) a shaft having an upper and lower end, and (ii) a hand grip attached to the upper end of said shaft, (iii) said lower end of said shaft secured to said engaging head.

2. An apparatus as recited in claim 1, wherein said vertical support member further comprises a pair of uprights having a plurality of apertures identically spaced along the length of each of said uprights, and wherein said lever arm is pivotally connected to said uprights.

3. An apparatus according to claim 1, further comprising means for limiting motion of said lever arm.

4. An apparatus as recited in claim 3, wherein said means for limiting the motion of said lever arm comprises a bolt disposed in apertures in said uprights.

5. An apparatus as recited in claim 1, wherein said elongate coupling member comprises a chain.

6. An apparatus as recited in claim 1, wherein said forward end of said lever arm has a plurality of apertures along its length, and wherein said coupling member is releasably coupled to said lever arm.

7. An apparatus as recited in claim 1, wherein at least one of the projections of said engaging head can be positioned and anchored relative to at least one fixed projection.

8. An apparatus as recited in claim 1, wherein said hand grip is substantially perpendicular to said shaft, and wherein said hand grip is disposed in an aperture in said vertical support member.

9. An apparatus as recited in claim 8, wherein said hand grip further comprises a bore and a locking pin received within the bore.

10. An apparatus as recited in claim 9, further comprising a tether secured to the vertical support member and said locking pin.

11. A stake or post extracting device, comprising:

(a) a base;

(b) a vertical support member having an upper end and a lower end, said lower end being securely attached to said base;

(c) a lever arm having a forward end and a rearward end;

(d) means for pivotally coupling said lever arm and said vertical support member;

(e) an engaging head, said head having a plurality of outwardly extending projections;

(f) an elongate coupling member having first and second sections, said first section coupled to said forward end of said lever arm, said second section coupled to said engaging head; and (g) a positioning handle comprising (i) a shaft having an upper and lower end, and (ii) a hand grip attached to the upper end of said shaft, (iii) said lower end of said shaft secured to said engaging head.

12. An apparatus as recited in claim 11, wherein said vertical support member further comprises a pair of uprights having a plurality of apertures identically spaced along the length of each of said uprights, and wherein said lever arm is pivotally coupled to said uprights.

13. An apparatus as recited in claim 11, further comprising means for limiting motion of said lever arm.

14. An apparatus as recited in claim 12, wherein said means for limiting motion of said lever arm comprises a bolt disposed in said apertures of said uprights.

15. An apparatus as recited in claim 11, wherein said elongate coupling member comprises a chain.

16. An apparatus according to claim 11, wherein said forward end of said lever arm includes a plurality of apertures along its length, and wherein said coupling member is releasably coupled to said lever arm.

17. An apparatus as recited in claim 11, wherein said engaging head further comprises at least one of said projections slideably mounted to the face of said engaging head.

18. An apparatus as recited in claim 11, wherein said hand grip is perpendicular to said shaft, and wherein said grip is disposed in an aperture in said vertical support member.

19. An apparatus as recited in claim 18, wherein said hand grip further comprises a bore and a locking pin received within said bore.

20. An apparatus as recited in claim 19, further comprising a cable secured to the vertical support member and said locking pin.

21. A stake or post extracting device, comprising:

(a) a base;

(b) a vertical support member having an upper end and a lower end, said lower end securely attached to said base, said upper end including a pair of upright projections having a plurality of apertures identically spaced along the length of said projections;

(c) a lever arm having a forward end and a rearward end, (d) means pivotally coupling said lever arm and said upright projections of the vertical support member;

(e) an engaging head, said engaging head having a plurality of outwardly extending projections extending;

(f) an elongate coupling member having first and second sections, said first section coupled to said forward end of said lever arm, said second section coupled to said engaging head; and (g) a positioning handle comprising (i) a shaft having an upper and lower end, and (i) a hand grip attached to the upper end of said shaft, (iii) said lower end of said shaft secured to said engaging head.

22. An apparatus as recited in claim 21, further comprising means for limiting motion of the lever arm.

23. An apparatus as recited in claim 22, wherein said means for limiting motion of said lever arm comprises a bolt disposed in said apertures of said upright projections.

24. An apparatus as recited in claim 21, wherein said elongate coupling member comprises a chain.

25. An apparatus according to claim 21, wherein said forward end of said lever arm includes a plurality of apertures along its length, and wherein said coupling member is releasably coupled to said lever arm.

26. An apparatus as recited in claim 21, wherein said engaging head further comprises at least one of said projections slideably mounted to the face of said engaging head.

27. An apparatus as recited in claim 21, wherein said hand grip is substantially perpendicular o said shaft, and wherein said grip is disposed in an aperture in said vertical support member.

28. An apparatus as recited in claim 21, said hand grip further comprises a bore and a locking pin received within said bore.

29. An apparatus as recited in claim 28, further comprising a cable secured to the vertical support member and said locking pin.

* * * * *